US006111397A

United States Patent [19]

Leung

[11] Patent Number: 6,111,397

[45] Date of Patent: Aug. 29, 2000

[54] TEMPERATURE-COMPENSATED REFERENCE VOLTAGE GENERATOR AND METHOD THEREFOR

[75] Inventor: David Leung, Cupertino, Calif.

[73] Assignee: LSI Logic Corporation, Milpitas, Calif.

[21] Appl. No.: 09/120,622

[22] Filed: Jul. 22, 1998

[51] Int. Cl.[7] ..... G05F 3/16

[52] U.S. Cl. ..... 323/315; 323/313; 323/312; 323/907; 327/513

[58] Field of Search ..... 323/315, 313, 323/312, 311, 907; 327/513

[56] References Cited

U.S. PATENT DOCUMENTS

| | | | |
|---|---|---|---|
| 5,430,395 | 7/1995 | Ichimaru | 327/312 |
| 5,545,978 | 8/1996 | Pontious | 323/313 |
| 5,572,161 | 11/1996 | Myers | 327/538 |
| 5,589,800 | 12/1996 | Peterson | 330/288 |
| 5,604,467 | 2/1997 | Matthews | 323/907 |
| 5,804,958 | 9/1998 | Tsui et al. | 323/313 |

*Primary Examiner*—Peter S. Wong
*Assistant Examiner*—Rajnikant B. Patel

[57] ABSTRACT

A reference voltage generator for producing a regulated, temperature-compensated output voltage from an unregulated power supply voltage is provided herein. The reference voltage generator includes a pre-regulating circuit and a temperature-compensating circuit. The temperature compensating circuit includes a first series path comprising a first cascode current sources and a first resistor; a second series path comprising a second cascode current source, a first field effect transistor and a first diode; and a third series path comprising a third cascode current source, a second field effect transistor, a second resistor and a second diode. The first series path being connected to the second series path between the first field resistor and the first diode. The current produced by the first current source, develops a voltage across the first resistor, which varies at least as a function of the ratio of the first and second resistors, the ratio of the diode junction areas, the dimensions of the first and second field effect transistors, and the first diode thermal voltage which has a positive temperature coefficient. The voltage across the first diode has a negative temperature coefficient. The output voltage taken across both the first resistor and first diode can be made substantially temperature invariant if the resistor ratio is selected such that it amplifies the temperature coefficient of the thermal voltage so that it is substantially equal and opposite to the temperature coefficient of the first diode voltage.

29 Claims, 4 Drawing Sheets

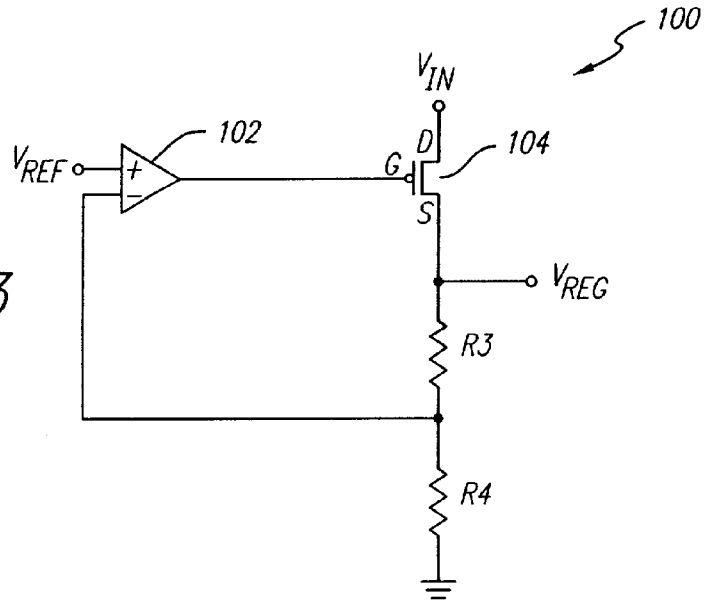
FIG. 3
FIG. 4
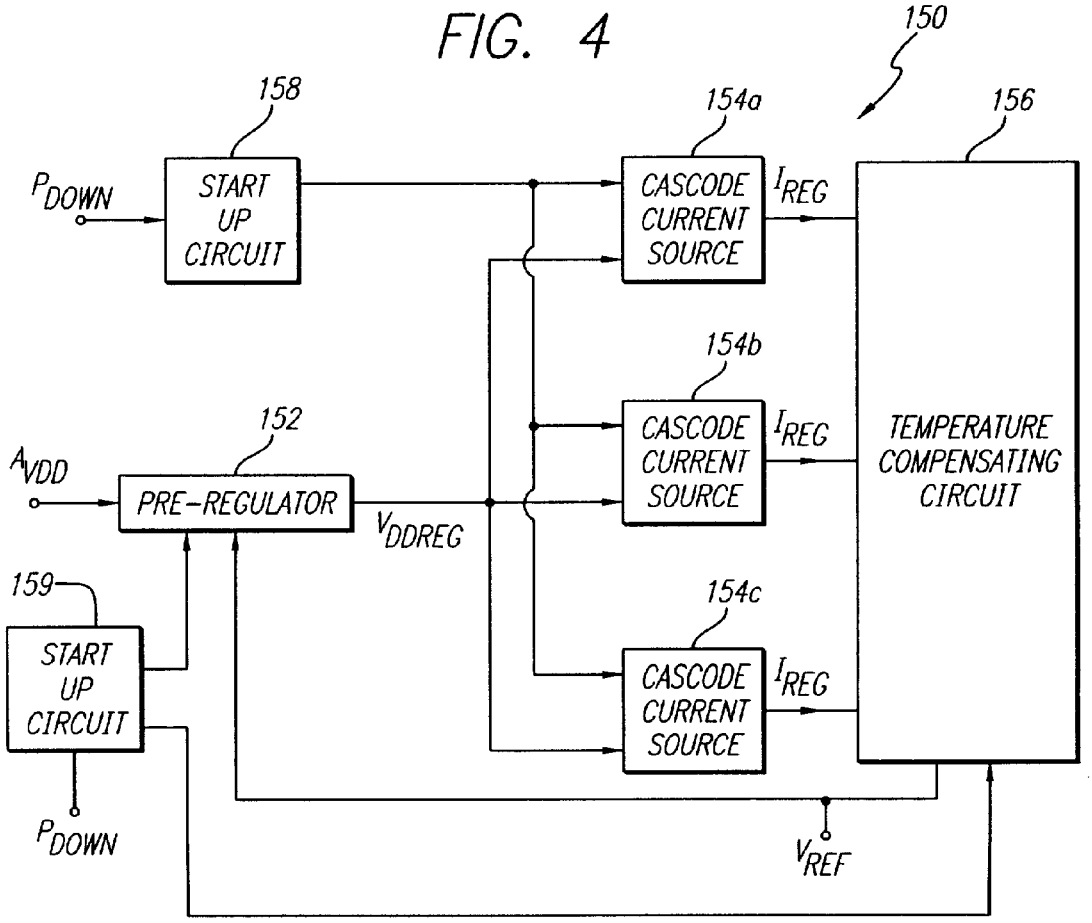

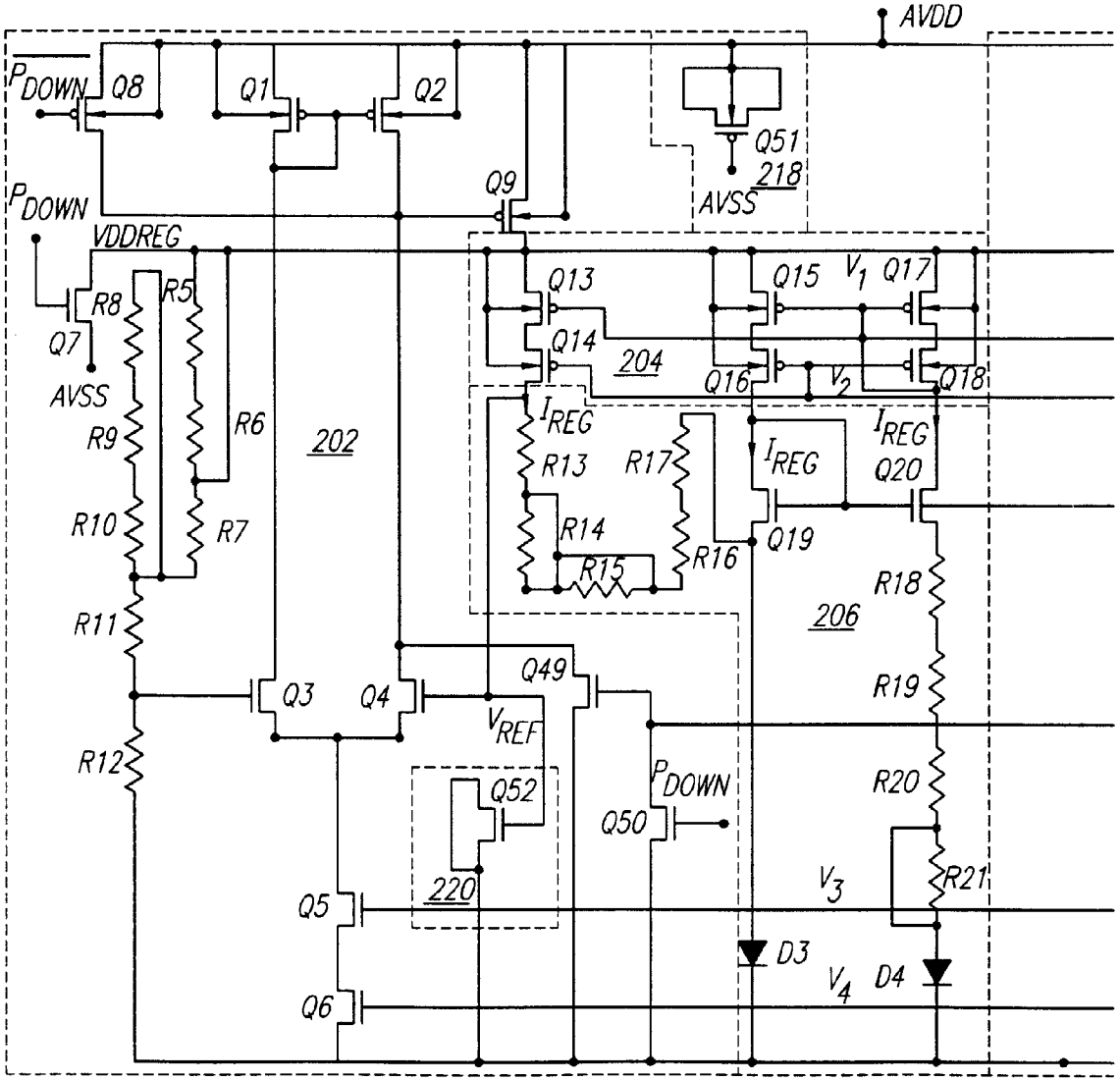
200
FIG. 5-A

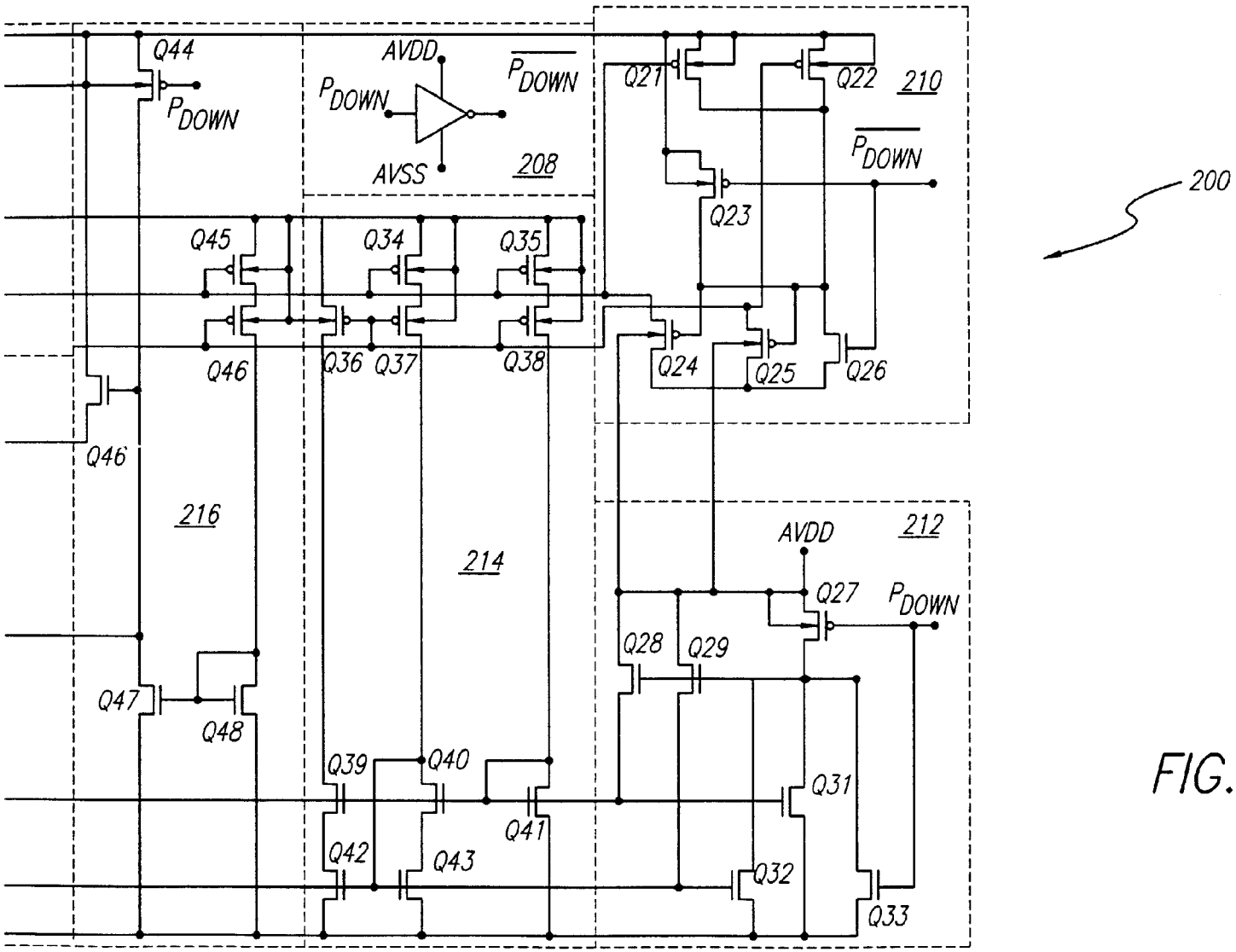
FIG. 5-B

TEMPERATURE-COMPENSATED REFERENCE VOLTAGE GENERATOR AND METHOD THEREFOR

FIELD OF THE INVENTION

This invention relates generally to reference voltage generation, and in particular, to a novel method and apparatus for providing a reference voltage that has improved temperature independency, improved power supply rejection ratio (PSRR), and improved resistance to process or manufacturing imperfection.

BACKGROUND OF THE INVENTION

The generation of a reference voltage can be used in many applications. For instance, a reference voltage generator is typically a main component of a voltage regulator. Voltage regulators, for example, are often used in circuits for conversion of alternating current (ac) into direct current (dc) for providing a stable output voltage from an unregulated rectified input voltage. A reference voltage generator can also be used in dc-to-dc converters for providing a regulated output dc voltage from an unregulated input dc voltage. In addition, a reference voltage generator can also be used in analog-to-digital converters to provide regulated reference voltages for comparison with analog voltages that are to be digitized. For the purpose of the invention, the particular application of the reference voltage generator and method of the invention is not critical to the invention. Therefore, the invention can encompass any reference voltage generator and method used in any application where the need for a reference voltage is desired.

The design of a reference voltage generator is often governed by the need of achieving many desired characteristics or performances for such devices or circuits. For instance, it is desirable for a reference voltage to be substantially invariant with changes in the environment temperature. It is also desirable for a reference voltage to be substantially immune to noise and/or unwanted signals present at the unregulated power supply. Even yet, it is desirable for a reference voltage generator that can be easily manufactured without the need for achieving precise characteristics for at least some of its components.

In many instances, reference voltage generators are used in many applications where they are exposed to varying environment temperatures. It is a concern for designers to provide a reference voltage that is substantially independent of changes in the environment temperature. Typically, however, reference voltage generators comprise a plurality of components that have characteristics that vary with temperature. These temperature-varying characteristics of such components will typically affect the reference voltage produced by a reference voltage generator, unless the generator is properly temperature compensated. Accordingly, there is a need for an apparatus and method for temperature compensating a reference voltage generator in order to provide a reference output voltage that is substantially temperature independent.

Another concern for designers of reference voltage generators is the integrity of the output reference voltage. It is preferred that an output reference voltage be substantially free from noise and/or unwanted signals present in the power supply. However, often the power supply feeding a reference voltage generator includes noise, spurs, spikes, surges, and/or other unwanted signals. If a reference voltage generator is not properly designed, these unwanted noise and/or signals at the power supply will appear at the output reference voltage. Such a reference voltage generator would be characterized as having a poor power supply rejection ratio (PSRR). Accordingly, there is a need for an apparatus and method for better isolating the output reference voltage from noise and/or unwanted signals present in the unregulated power supply.

Yet another concern for designers of reference voltage generators is the processing or manufacturing of the voltage reference devices or circuits. Often these reference voltage generators are configured into integrated circuits using, for example, complimentary metal oxide semiconductor (CMOS) technology, which includes the deposition of different types of thin-films and ion implants. It is well known that semiconductor processing of integrated circuits is not a perfect art, and often imperfections occur in the manufacturing of integrated circuit components. For instance, it is often difficult to obtain an accurate particular value for an implanted well resistor used in an integrated circuit because of semiconductor processing imperfections. Accordingly, there is a need for a reference voltage generator and method that is not substantially dependent on the particular value of an integrated circuit component, such as the absolute value of a resistor.

OBJECT OF THE INVENTION

Accordingly, the following includes some, but not all, objects achieved by the disclosed invention:

It is a general object of the invention to provide a reference voltage generator;

It is another object of the invention to provide a reference voltage generator that produces a regulated output voltage that is substantially temperature invariant;

It is another object of the invention to provide a reference voltage generator that provides improved isolation of its regulated output voltage from noise and/or unwanted signals present in the unregulated power supply voltage;

It is another object of the invention to provide a reference voltage generator that has improved power supply rejection ratio (PSRR);

It is another object of the invention to provide a reference voltage generator configured into an integrated circuit, that is less susceptible to processing or manufacturing imperfections; and It is another object of the invention to provide a reference voltage generator whose various functional blocks vary as a function of a resistor ratio to eliminate the need to have precise resistor values for the reference voltage generator.

SUMMARY OF THE INVENTION

One aspect of the invention is an apparatus for producing an output voltage that is substantially invariant with changes in an environment temperature. The temperature-compensating apparatus preferably comprises a current source for producing a current; a current control circuit for controlling the current such that a compensating voltage is developed that varies with the environment temperature in accordance with a first temperature coefficient. The current control circuit further includes a first active device for developing a device voltage that varies with the temperature in accordance with a second temperature coefficient that is substantially equal and opposite to the first temperature coefficient. The output voltage of the apparatus is a function of the device voltage and the compensating voltage.

Another aspect of the invention is a method of forming a voltage that is substantially invariant with changes in an environment temperature. The method preferably comprises forming a current that develops a compensating voltage that varies with the environment temperature in accordance with a first temperature coefficient; providing the current through a first active device that develops a device voltage that varies with the exposed temperature in accordance with a second temperature coefficient that is substantially equal and opposite to the first temperature coefficient; and forming the output voltage from the compensating voltage and the device voltage.

Yet another aspect of the invention is a reference voltage generator for producing a regulated output voltage that is substantially invariant with changes in an environment temperature. The reference voltage generator preferably comprises a pre-regulator producing an intermediate voltage that is potentially better regulated than the power supply voltage. The reference voltage generator also comprises a temperature-compensating circuit, that includes noise rejection capabilities. The temperature compensating circuit preferably comprises a current source for producing a current in response to the intermediate voltage; a current control circuit for controlling the current such that a compensating voltage is developed that varies with the environment temperature in accordance with a first temperature coefficient; and a first active device for developing a device voltage in response to the current that varies with the temperature in accordance with a second temperature coefficient that is substantially equal and opposite to the first temperature coefficient. The output voltage of the reference voltage generator is a function of the device voltage and the compensating voltage.

Another aspect of the invention includes an apparatus for generating a reference voltage in response to an input voltage, comprising a pre-regulator for producing an intermediate voltage in response to the input and reference voltages; a current source for producing a current in response to the intermediate voltage; and a temperature compensating circuit for substantially stabilizing the reference voltage with temperature variation in response to the current. The feedback of the output reference voltage $V_{REF}$ from the temperature compensating circuit back to the pre-regulator provides for a boot strap effect.

BRIEF DESCRIPTION OF THE DRAWINGS

The above mentioned objects, other objects and features of the invention and the manner of attaining them will become apparent, and the invention itself will be best understood by reference to the following description of the preferred embodiments of the invention taken in conjunction with the accompanying drawings, wherein:

FIG. 3 is a schematic diagram of a pre-regulator circuit for a reference voltage generator in accordance with another aspect of the invention;

FIG. 4 is a block diagram of a reference voltage generator in accordance with another aspect of the invention; and FIG. 5 is a schematic diagram of a reference voltage generator in accordance with another aspect of the invention.

DETAILED DESCRIPTION OF THE PREFERRED EMBODIMENTS

Figure 1:
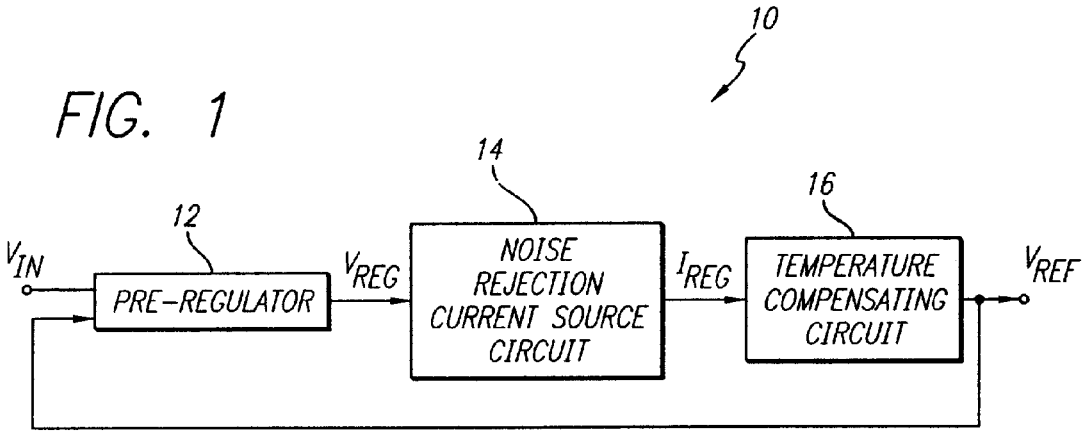
FIG. 1 is a block diagram of a reference voltage generator in accordance with an aspect of the invention.

Referring to FIG. 1, a block diagram of a reference voltage generator 10 in accordance with an aspect of the invention is shown. The general object of the reference voltage generator 10 is to produce a reference output voltage, such as $V_{REF}$. Other objectives of the reference voltage generator 10 include providing a reference output voltage $V_{REF}$ that is substantially environment temperature invariant, and also providing a reference voltage $V_{REF}$ that is substantially immune to noise and/or unwanted signals that may be present in the power supply. In order to accomplish these objectives, the reference voltage generator 10 of the invention preferably includes a pre-regulator 12, a noise rejection circuit 14 preferably comprising a current source circuit, and a temperature compensating circuit 16.

The pre-regulator 12 provides for an initial stage of voltage regulation for the reference voltage generator 10. More specifically, the input voltages to the pre-regulator 12 is preferably a voltage $V_{IN}$ from an unregulated power supply and $V_{REF}$, the output of the reference voltage generator 10. In response, the pre-regulator 12 produces a more regulated voltage $V_{REG}$, i.e. a voltage that is less susceptible to variations in the power supply. The pre-regulator 12 may also have some noise rejection properties in that less than all the noise and/or unwanted signals present in the power supply are produced at the output of the pre-regulator, i.e. the pre-regulated voltage $V_{REG}$.

The reference voltage generator 10 of the invention also preferably includes a noise rejection circuit 14 for further rejecting of the noise and/or the unwanted signals present in the power supply. More specifically, the noise rejection circuit 14, preferably in the form of a current source circuit, receives the regulated voltage $V_{REG}$ from the output of the pre-regulator 12, and preferably produces a regulated current $I_{REG}$. The noise rejection circuit 14 provides further noise rejection, in addition to that provided by the pre-regulator 12, so that the regulated current $I_{REG}$ is further immune from the noise and/or the unwanted signals present in the unregulated power supply.

In addition to the initial level of regulation provided by the pre-regulator 12 and to the noise rejection properties of both the pre-regulator and the noise rejection circuit 14, the reference voltage generator 10 also includes a temperature compensating circuit 16. The temperature compensating circuit 16 is coupled to the noise rejection circuit 14 for receiving therefrom the regulated current $I_{REG}$. From the regulated current $I_{REG}$, the temperature compensating circuit 16 produces the regulated output voltage $V_{REF}$ that is substantially invariant to changes in the environment or exposed temperature. The output reference voltage $V_{REF}$ is also fed back to the pre-regulator 12, which provides a boot strap effect.

In summary, the reference voltage generator 10 of the invention provides an output reference voltage $V_{REF}$ from an unregulated power supply. The reference voltage generator 10 includes an initial stage of regulation and noise rejection performed by the pre-regulator 12, a second stage of noise rejection performed by the noise rejection circuit 14, and a stage for temperature compensating the output voltage $V_{REF}$ performed by the temperature compensating circuit 16. Thus, the output voltage $V_{REF}$ is not only regulated, it is also immune from noise and/or unwanted signals present in the unregulated power supply, and substantially temperature invariant.

Figure 2:
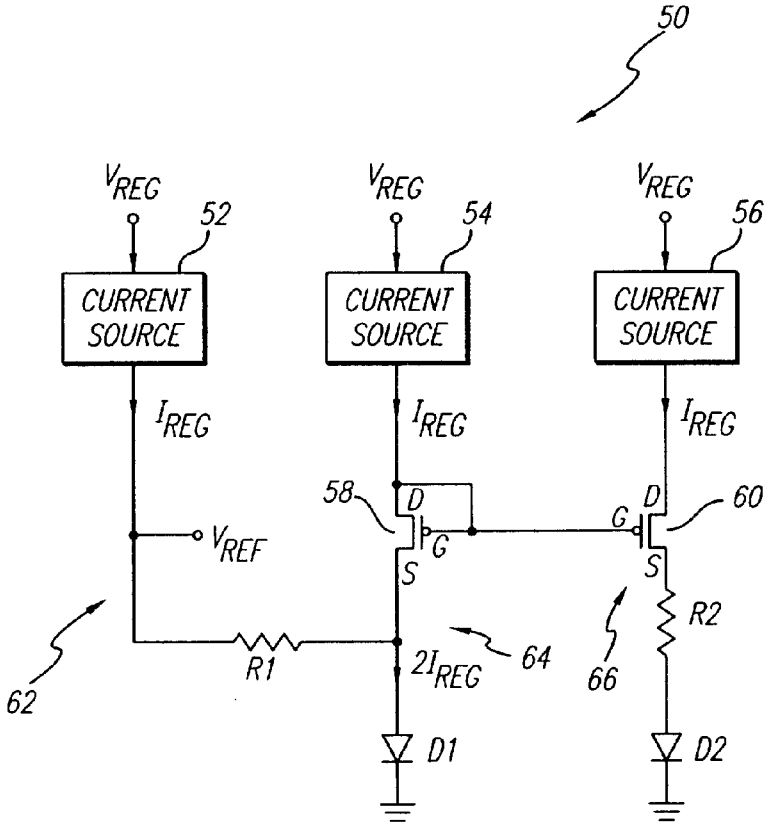
FIG. 2 is a schematic and block diagram of a temperature-compensating circuit for a reference voltage generator in accordance with another aspect of the invention.

FIG. 2 illustrates a schematic and block diagram of a temperature compensating circuit 50 in accordance with another aspect of the invention. The purpose or objective achieved by the temperature compensating circuit 50 is to produce an output reference voltage $V_{REF}$ that is substantially temperature invariant from a voltage, such as $V_{REG}$, that, in turn, may or may not be substantially temperature invariant. Although the temperature compensating circuit 50 will be described as being used in a reference voltage generator for temperature compensating its regulated output voltage, it shall be understood that such temperature compensating circuit may be used in many other applications, where temperature compensating of a response is desired.

Conceptually, the temperature compensating circuit 50 comprises a current source for producing a current $I_{REG}$, and a current control circuit for controlling the current $I_{REG}$. More specifically, the current controlling circuit regulates the current $I_{REG}$ such that it varies preferably as a function of at least two parameters. One of these parameters varies with temperature in accordance with a first temperature coefficient. The other parameter is an "amplifier" or "modifier," for amplifying or modifying the first temperature coefficient of the first parameter.

The current $I_{REG}$ is introduced into a resistive element connected in series with an active device. The voltage developed across the active device varies with temperature in accordance with a second temperature coefficient. The voltage across the resistive element varies with temperature in accordance with the first temperature coefficient of the first parameter being altered by the "amplifier" or "modifier." By properly selecting the "amplifier" or "modifier", the first temperature coefficient can be made substantially equal and opposite to the second temperature coefficient. This results in an output voltage, taken across both the resistive element and the active device, to be substantially invariant with the environment or exposed temperature.

More specifically, the temperature compensating circuit 50 preferably comprises, as the current source described above, three current sources 52, 54 and 56, and a current controlling circuit preferably comprising a pair of field effect transistors (FETs) 58 and 60, a pair of resistors R1 and R2, and a pair of diodes D1 and D2. The temperature compensating circuit 50 is preferably configured to form three series paths. A first series path 62 comprises current source 52 and resistor R1; a second series path 64 comprises current source 54, the channel of FET 58, and diode D1; and a third series path 66 comprises current source 56, the channel of FET 60, resistor R2 and diode D2. The first series path 62 is preferably connected to the second series path 64 between the FET 58 and the diode D1. The gate of FET 58 is preferably connected to the gate of FET 60 and to current source 54 (or alternatively, it can be connected to current source 56). The cathodes of the diodes D1 and D2 are preferably connected to ground.

In the preferred embodiment, the temperature compensating circuit 50 receives the regulated voltage $V_{REG}$ produced by a pre-regulator, such as for example, pre-regulator 12 of FIG. 1. In response, the current sources 52, 54 and 56 being substantially identical matched mirrors should produce substantially equal currents of $I_{REG}$. The current sources 52, 54 and 56, which are preferably cascode current sources, provide additional isolation of noise and/or unwanted signals present in the unregulated power supply.

In the preferred configuration of the temperature compensating circuit 50, the currents $I_{REG}$ produced by the current sources 52, 54 and 56 propagate via the first, second and third series paths 62, 64 and 66. Because the first and the second series paths 62 and 64 are preferably connected to each other between the FET 58 and the diode D1, the currents $I_{REG}$ will add at the node, resulting in a current of $2I_{REG}$ propagating through the diode D1.

In this preferred configuration of the temperature-compensating circuit 50, the output reference voltage (i.e. $V_{REF}$) taken off the first series path 62 between the current source 52 and resistor R1 can be made to be substantially environment temperature invariant by proper selection of the other components of the circuits, namely the device size of the FETs, the junction area ratio of the diodes D1 and D2, and/or the resistance ratio of R1 and R2. The following provides a derivation of the output reference voltage $V_{REF}$ as a function of the component parameters of circuit 50, and how proper selection of such parameters can produce a substantially temperature-invariant output voltage $V_{REF}$.

The drain current $I_D$ through a FET, such as a MOSFET, may be given by the following equation:

$$I_D=\beta(V_{gs}-V_{th})^2 \qquad \text{Eq.) 1}$$

whereby $V_{gs}$ is the gate-source voltage, $V_{th}$ is the threshold voltage of the FET, and β may be given by the following equation:

$$\beta=\mu\left(\frac{C_{OX}}{2}\right)\left(\frac{W}{L}\right) \qquad \text{Eq.) 2}$$

whereby $\mu$ is the mobility of the FET channel, $C_{OX}$ is the gate oxide capacitance, W is the width of the channel, and L is the length of the channel. Since the current sources 54 and 56 produce substantially the same currents $I_{REG}$, the drain currents $ID_{D1}$ and $I_{D2}$ of FETs 58 and 60 are also substantially the same, i.e. the following relationship substantially holds:

$$I_{REG}=I_{D1}=I_{D2} \qquad \text{Eq.) 3}$$

Substituting equation 1 into equation 3, and assuming the same threshold voltage for the FETs 58 and 60, the following relationship substantially holds:

$$I_{REG}=\beta_1(V_{gs1}-V_{th})^2=\beta_2(V_{gs2}-V_{th})^2 \qquad \text{Eq.) 4}$$

wherein the subscripts 1 and 2 designate the corresponding parameters pertaining to FETs 58 and 60, respectively.

Equation 4 can be rewritten as follows:

$$V_{gs1}=\sqrt{\frac{I_{REG}}{\beta_1}}+V_{th} \qquad \text{Eq.) 5a}$$

$$V_{gs2}=\sqrt{\frac{I_{REG}}{\beta_2}}+V_{th} \qquad \text{Eq.) 5b}$$

Since the respective gates of the FETs 58 and 60 are connected to each other, the voltages at the gates are substantially the same. As a result, the following relationship substantially holds:

$$V_{gs1}+V_{d1}=V_{gs2}+I_{REG}.R2+V_{d2} \qquad \text{Eq.) 6}$$

whereby $V_{d1}$ and $V_{d2}$ are the voltages across diodes D1 and D2. Substituting equations 5a and 5b into equation 6, the following relationship substantially holds:

$$\sqrt{\frac{I_{REG}}{\beta_1}}+V_{th}+V_{d1}=\sqrt{\frac{I_{REG}}{\beta_2}}+V_{th}+I_{REG}\cdot R2+V_{d2} \qquad \text{Eq.) 7}$$

Equation 7 can be rewritten as follows:

$$\sqrt{I_{REG}}\left(\frac{1}{\sqrt{\beta_1}}-\frac{1}{\sqrt{\beta_2}}\right)=I_{REG}\cdot R2+V_{d2}-V_{d1} \quad \text{Eq.) 8}$$

It is known that the current through a diode can be represented by the following relationship:

$$I_d=J_sAe^{(}Vd/VT) \quad \text{Eq.) 9}$$

whereby $J_s$ is the saturation current density of the diode, A is the cross-sectional area of the diode junction, $V_d$ is the voltage across the diode, and $V_T$ is the diode thermal voltage. Equation 9 can be rewritten as follows:

$$V_d=V_T\ln\left(\frac{I_d}{J_s\cdot A}\right) \quad \text{Eq.) 10}$$

Substituting equation 10 into equation 8 and letting the subscripts 1 and 2 represent the corresponding parameters for diodes D1 and D2, respectively, the following relationship is obtained:

$$\sqrt{I_{REG}}\left(\frac{1}{\sqrt{\beta_1}}-\frac{1}{\sqrt{\beta_2}}\right)=I_{REG}\cdot R2+V_T\cdot\left[\ln\left(\frac{I_{REG}}{J_s\cdot A_2}-\frac{2\cdot I_{REG}}{J_sA_1}\right)\right] \quad \text{Eq.) 11}$$

$$=I_{REG}\cdot R2+V_T\ln\left(\frac{A_1}{2\cdot A_2}\right)$$

To obtain $I_{REG}$, equation 11 can be rewritten in a quadratic formula format as follows:

$$I_{REG}+\frac{\sqrt{I_{REG}}}{R2}\cdot\left(\frac{1}{\sqrt{\beta_2}}-\frac{1}{\sqrt{\beta_1}}\right)-\frac{V_T}{R2}\cdot\ln\left(2\cdot\frac{A_2}{A_1}\right)=0 \quad \text{Eq.) 12}$$

Solving the quadratic formula, the following relationship is obtained:

$$I_{REG}=\left[\frac{1}{2\cdot R2}\cdot\left(\frac{1}{\sqrt{\beta_1}}-\frac{1}{\sqrt{\beta_2}}\right)\pm\frac{1}{2}\sqrt{\frac{1}{R2^2}\cdot\left(\frac{1}{\sqrt{\beta_2}}-\frac{1}{\sqrt{\beta_1}}\right)^2+\frac{4V_T}{R2}\cdot\ln\left(\frac{2A_2}{A_1}\right)}\right]^2 \quad \text{Eq.) 13}$$

The output reference voltage $V_{REF}$ of the temperature compensating circuit 50 may be represented substantially by the following relationship:

$$V_{REF}=V_{d1}+I_{REG}.R1 \quad \text{Eq.) 14}$$

Substituting equation 13 for $I_{REG}$ in equation 14, the following relationship for the output reference voltage $V_{REF}$ substantially holds:

$$V_{REF}=V_{d1}+\frac{R1}{R2^2}\left[\frac{1}{2}\cdot\left(\frac{1}{\sqrt{\beta_1}}-\frac{1}{\sqrt{\beta_2}}\right)\pm\frac{1}{2}\sqrt{\left(\frac{1}{\sqrt{\beta_2}}-\frac{1}{\sqrt{\beta_1}}\right)^2+4V_T\cdot R2\cdot\ln\left(\frac{2A_2}{A_1}\right)}\right]^2 \quad \text{Eq.) 15}$$

Thus in general, the output reference voltage $V_{REF}$ can be made substantially temperature invariant by proper design and selection of the diode junction areas $A_1$ and $A_2$, the resistors R1 and R2, and the parameters of the FETs $\beta_1$ and $\beta 2$.

If in the preferred embodiment, the FETs 58 and 60 are substantially identical matched, and thereby, have the same $\beta$ (i.e. $\beta_1=\beta_2$), then equation 13 reduces to substantially the following relationship:

$$I_{REG}=\frac{V_T}{R2}\ln\left(2\cdot\frac{A_2}{A_1}\right) \quad \text{Eq.) 16}$$

Then, substituting equation 14 into equation 15, the following relationship for the output reference voltage substantially holds:

$$V_{REF}=V_{d1}+V_T\cdot\left(\frac{R1}{R2}\right)\cdot\ln\left(2\cdot\frac{A_2}{A_1}\right) \quad \text{Eq.) 17}$$

The output reference voltage can be made temperature invariant by proper design and selection of the diode cross-sectional junction areas $A_1$ and $A_2$, and the resistors R1 and R2. More specifically, a silicon diode, for example, has a voltage $V_{d1}$ that has a temperature coefficient of about −2.2 mV/° C. and a thermal voltage $V_T$ that has a temperature coefficient of about +0.085 mV/° C. As a result, for a silicon diode, the variation of the output voltage $V_{REF}$ with temperature can be approximated by the following equation:

$$\Delta V_{REF}(\text{mV})=-2.2(T)+0.08(T)\cdot\frac{R1}{R2}\cdot\ln\left(\frac{2\cdot A_2}{A_1}\right) \quad \text{Eq.) 18}$$

whereby T is the environment temperature. In this case, $V_{REF}$ can be made substantially temperature invariant if the cross-sectional areas $A_1$ and $A_2$ of the diodes D1 and D2, and the resistors R1 and R2, are such that it can "amplify" or "modify" the temperature coefficient of the thermal voltage $V_T$ (e.g. +0.085 mV/° C.) so that it is equal and opposite to the temperature coefficient of the diode voltage $V_{d1}$ (e.g. −2.2 mV/° C.). In this case, both temperature coefficients will substantially cancel out. Thus, by properly designing the cross-sectional junction areas of the diodes $A_1$ and $A_2$, and selecting the values for the resistors R1 and R2, the output voltage $V_{REF}$ of the temperature compensating circuit 50 can be made substantially temperature invariant.

Because the circuit parameters (i.e. $A_1$, $A_2$, R1, and R2) can be made to "amplify" or "modify" the temperature coefficient of the thermal voltage $V_T$ such that it can be made substantially equal and opposite to the temperature coefficient of the diode voltage $V_{d1}$, these parameters can be termed an amplification or modification factor M. Thus, equation 17 can be rewritten as follows:

$$V_{REF}=V_{d1}+V_T.M \quad \text{Eq.) 19}$$

whereby M is substantially equal to $$\frac{R1}{R2}\cdot\ln\frac{2\cdot A_2}{A_1}.$$

To further simplify the amplification or modification factor M, the diodes can be made to have a fixed ratio of the same cross-sectional areas (i.e. $A_1/A_2$=constant). Thus, the amplification or modification factor M can be substantially given by the following relationship:

$$M=\frac{R1}{R2}\cdot\text{constant} \qquad \text{Eq.) 20}$$

In this case, the amplification factor M is only a function of the resistors R1 and R2. This provides for substantial advantage since the resistors can be adjusted or trimmed (such as by conventional methods) so that the desired amplification or modification factor M is achieved in order to make the output voltage $V_{REF}$ of the temperature compensating circuit 50 substantially temperature invariant.

An additional advantage is that the amplification factor M depends on a resistor ratio (i.e. R1/R2) and diode junction area ratio ($A_1/A_2$), rather than the absolute value of a resistor or diode area. Often the temperature compensating circuit 50 is configured as an integrated circuit. The process of forming an integrated circuit is not without process imperfections. This is particularly true for the formation of ion implanted well resistors. If, suppose, the amplification factor M depended only on the absolute value of a thin-film resistor, substantial errors and variations would result for different lots of integrated circuits. However, because process errors typically affect all resistors in substantially the same way, an amplification factor dependent on a resistance ratio is less susceptible to process errors, since errors in both resistors are somewhat canceled out by the ratio. Thus, by using resistor ratio, better control in the manufacturing of the temperature compensating circuit 50 is achieved.

Although in the derivation of output reference voltage $V_{REF}$ given by equation 17 it was assumed that the FETs 58 and 60 are matched, it shall be understood that such devices need not be matched. If they are not matched, the output voltage $V_{REF}$ is also dependent on $\beta_1$ and $\beta_2$ of FETs 58 and 60, in addition to the diode parameters ($A_1$, $A_2$ and $V_{d1}$) and the resistors R1 and R2, as shown in equation 15. Thus, in order to provide an output reference voltage $V_{REF}$ that is substantially temperature invariant, consideration of these additional parameters need to be taken into account.

In the preferred embodiment, the temperature compensating circuit 50 is formed as part of a reference voltage generator configured into an integrated circuit using silicide complementary metal oxide semiconductor (CMOS) technology on silicon substrate. Thus, the diodes are preferably silicon diodes, which in this case they are preferably formed by implanting heavy doses of $P^+$ onto an N-well, and the FETs 50 and 58 are preferably N-channel metal oxide semiconductor field effect transistors (MOSFETs). It shall be understood that the temperature compensating circuit 50 may be formed using other types of technology, such as bipolar technology and could also be formed on other types of substrates.

FIG. 3 is a schematic and block diagram of a pre-regulator 100, as a preferred manner of configuring the pre-regulator 12 of FIG. 1. The pre-regulator 100 preferably comprises an operational amplifier (Op Amp) 102, a FET 104 (more preferably a P-channel MOSFET), and resistors R3 and R4. The channel of the FET 104 and the resistors R3 and R4 are connected in series between the unregulated power supply $V_{IN}$ and ground. The voltage at a node between resistors R3 and R4 is fed back to the negative (inverting) input of the Op Amp 102. The output reference voltage $V_{REF}$ of the reference voltage generator is fed back to the pre-regulator 100, and specifically, to the positive (non-inverting) input of the Op Amp 102. The output of the Op Amp 102 is coupled to the gate of the FET 104. The regulated voltage $V_{REG}$ is taken off the node between the FET 104 and resistor R3.

FIG. 4 shows a block diagram of an example of a preferred embodiment of a temperature-compensated reference voltage generator 150 in accordance another aspect of the invention. The reference voltage generator 150 preferably comprises a pre-regulator 12, three cascode current sources 154*a–c,* a temperature-compensating circuit 156, and start-up circuits 158 and 159.

The pre-regulator 152 produces a potentially more regulated voltage VDDREG than a voltage AVDD from an unregulated power supply. The pre-regulator 152 may be configured as pre-regulator 102 depicted in FIG. 100, or as depicted in FIG. 5, as will be explained later. The pre-regulator 152 also provides a first stage of noise filtering of the unregulated analog power supply voltage AVDD.

The output of the pre-regulator 152 is preferably coupled to the cascode current sources 154*a–c* for providing thereto the regulated voltage VDDREG. The cascode current sources 154*a–c* each produce a current $I_{REG}$ from the regulated voltage VDDREG. Since the current sources 154*a–c* are substantially identically matched mirrors, the currents $I_{REG}$ are substantially equal to each other. The cascode current sources 154*a–c* provide an additional stage of noise filtering of the regulated voltage VDDREG.

The cascode current sources 154*a–c* are coupled to the temperature compensating circuit or current controlling circuit 156 for providing thereto the currents $I_{REG}$. The temperature compensating circuit 156 is preferably of the same type shown in FIG. 2 or in FIG. 5, as will be later explained. The temperature-compensating circuit 156 produces an output reference voltage $V_{REF}$ that is substantially environment temperature invariant.

The start-up circuits 158 and 159 are coupled to the cascode current sources 154*a–c*, to the pre-regulator 152 and to the temperature-compensating circuit 156, respectively. The start-up circuits 158 and 159 set up, upon "start-up" or "power on" of the reference voltage generator 150, the initial bias voltages for the cascode current sources 154*a–c*, the pre-regulator 152 and the temperature compensating circuit 156. In the preferred embodiment, the start-up circuits 158 and 159 are responsive to a PDOWN signal for causing the reference voltage generator 150 to "shut down" when the PDOWN signal is a logical high, or causing the circuit 150 to start up when PDOWN signal is a logical low.

FIG. 5 shows a schematic diagram of a preferred embodiment of a temperature-compensated reference voltage generator 200 in accordance with the invention. The reference voltage generator 200 receives an unregulated power supply voltage AVDD, and produces therefrom, an output voltage $V_{REF}$ that is substantially regulated and also substantially environment temperature invariant. In the preferred embodiment, the temperature-compensated reference voltage generator 200 comprises a pre-regulator 202, a cascode current source circuit 204, a temperature-compensating circuit 206, an inverter circuit 208, and bias start-up circuits 210 and 212, bias voltage set up circuit 214, and a current start circuit 216.

The pre-regulator 202 provides an initial stage of regulation and noise filtering of the unregulated power supply voltage AVDD to produce a voltage VDDREG that is better regulated (i.e. it is potentially less susceptible to variations in the unregulated power supply voltage AVDD) and has an improved PSRR characteristic (i.e. its noise content is potentially less than that present in the unregulated power supply voltage AVDD). The pre-regulator 202 may also be biased with another voltage AVSS, but typically, AVSS is connected to a ground potential. In addition, the pre-regulator 202 may also be responsive to a PDOWN signal in order to "power on" or "power off" the reference voltage generator 200.

In the preferred embodiment, the pre-regulator 202 comprises FETs Q1–9, wherein transistors Q1–6 are configured to form an operational amplifier (Op Amp), and wherein the gate of transistor Q3 serves as the negative (inverting) input and the gate of transistor Q4 serves as the positive (non-inverting) input of the Op Amp, and the drain of transistor Q4 (or Q2) serves as the output of the Op Amp. The output reference voltage $V_{REF}$ of the reference voltage generator 200 is applied to the gate (or non-inverting input of the Op Amp) of transistor Q4.

The preferred pre-regulator 202 further includes a voltage divider circuit having resistors R5–R11 forming the first leg of the divider and resistor R12 forming the second leg of the divider. The regulated voltage VDDREG is applied to the voltage divider so that a portion of the VDDREG is applied to the gate (or inverting input of the Op Amp) of transistor Q3. Resistors R5–R11 are made variable in order to set the desired voltage at the gate of transistor Q3, thus varying the voltage level of VDDREG. In the preferred embodiment, some of the resistors R5–R11 are initially bypassed in order to make the total resistance variable by opening the shorts. In addition, these resistors can also be made variable by trimming any of the resistors.

In the preferred embodiment, the pre-regulator 202 includes circuitry responsive to the PDOWN signal in order to "turn on" or "turn off" the pre-regulator. Specifically, the pre-regulator 202 includes an n-channel FET Q7 having a gate for receiving a PDOWN signal, and drain and source connected to the regulated voltage VDDREG and AVSS (typically ground). The pre-regulator 202 also includes a p-channel FET Q8 having a gate for receiving an inverted PDOWN signal, and drain and source connected to the unregulated voltage AVDD and the output of the Op Amp. In addition, the pre-regulator 202 includes a p-channel transistor Q9, having the gate connected to the drain of transistor Q8, and source and drain connected to the unregulated power supply voltage AVDD and the regulated voltage VDDREG.

In operation, when the PDOWN signal goes "high" (meaning that the reference voltage generator is not being operated), transistor Q7 conducts, thereby forcing the VDDREG to be essentially at AVSS potential, or typically ground. At the same time, the inverted PDOWN signal goes "low" and causes transistor Q8 to conduct, thereby coupling the unregulated power supply voltage AVDD to the gate of transistors Q9. This causes transistors Q9 to turn off, thereby preventing AVDD to be shorted to ground through transistors Q7 and Q9, and causing damage to the circuit. The inverting circuit 208 produces the inverted PDOWN signal from the non-inverted PDOWN signal.

In the preferred embodiment, the cascode current circuit 204 comprises three cascode current sources comprised of p-channel FETs Q13–14, p-channel FETs Q15–16 and p-channel FETs Q17–18, respectively. Each of the cascode current sources are coupled to the regulated voltage VDDREG to produce therefrom currents $I_{REG}$ for use by the temperature-compensating circuit 206. Although each of the currents produce by the respective cascode current sources are designated as $I_{REG}$, it shall be understood that there can be minor variations between these currents. In other words, the currents $I_{REG}$ are substantially equal to each other. The cascode current sources also provide an additional stage of noise isolation between the input and output of the reference voltage generator.

In the preferred embodiment, the temperature-compensating circuit 206 is preferably a more detailed version of temperature-compensating circuit 50 shown in FIG. 2. More specifically, the temperature-compensating circuit 206 comprises n-channel FETs Q19–20, diodes D3–4, resistors R13–17, and resistors R18–R21. In the preferred embodiment, transistors Q19–20 are substantially matched, and thereby both have substantially the same physical dimensions of channel width and channel length (i.e. $\beta_{19}=\beta_{20}$). Also, in the preferred embodiment, the diodes D3–4 have a constant junction area ratio (i.e. $A_3/A_4$= constant). As a result, the output voltage $V_{REF}$ of the reference voltage generator is governed by equations 19 and 20 with R1 being replaced with the total resistance formed from resistors R13–17 and R2 being replaced with the total resistance formed from resistors R18–21. It shall be noted that these total resistance may be varied by opening the shorts across the resistors (e.g. R14–15 and R21) and/or by trimming any of these resistors in order to make the output voltage substantially temperature invariant according to equations 19 and 20.

The bias start-up circuit 210 of the reference voltage generator 200 selectively starts bias voltages $V_1$ and $V_2$ to the cascode current circuit 204 in response to the inverted PDOWN signal becoming "high" (i.e. the reference voltage generator 200 is in the power-up mode). Or conversely, as the inverted PDOWN signal becomes "low," the proper bias voltage $V_1$ and $V_2$ for the cascode current circuit 204 are removed (i.e. the reference voltage generator 200 is in the power-down mode). In the preferred embodiment, the bias start-up circuit 210 comprises p-channel FETs Q21–Q25 and n-channel FET Q26.

The bias start-up 212 of the reference voltage generator 200 selectively starts bias voltages $V_3$ and $V_4$ in response to the PDOWN signal becoming "low" (i.e. the reference voltage generator 200 is in the power-up mode). Or conversely, as the PDOWN signal becomes "high," the proper bias voltage $V_3$ and $V_4$ are removed (i.e. the reference voltage generator 200 is in the power-down mode). In the preferred embodiment, the bias start-up circuit 212 comprises p-channel FET Q27 and n-channel FETs Q28–Q33.

The bias voltage generation circuit 214 sets up and regulates the voltages $V_1$, $V_2$, $V_3$ and $V_4$ for the cascode current circuit 204. In the preferred embodiment, the bias voltage regulation circuit 214 comprises p-channel FETs Q34–38 and n-channel FETs Q39–43.

The current initialization circuit 216 initializes the operation of the temperature compensating circuit 206 and the pre-regulator 202. The initialization of the temperature-compensating circuit 216 is performed by the initialization circuit 216 introducing a voltage into the gates of transistors Q19–20 such that they conduct current. This allows the current $I_{REG}$ to flow through the temperature-compensating circuit 206. The current initialization circuit 216 is preferably responsive to the PDOWN signal in order to shut off the current $I_{REG}$ flow through the temperature-compensating circuit upon the PDOWN signal being enabled.

In addition, the current initialization circuit 216 also initializes the operation of the pre-regulator 202 by introducing a voltage onto the gate of n-channel transistor Q49. This causes transistor Q49 to conduct thereby initializing a current through the Op Amp in order to drop the voltages to the gates of transistors Q9. The transistor Q9, in turn, conducts and allows AVDD to conduct therethrough to the VDDREG voltage line. The current initialization circuit 216 is preferably responsive to the PDOWN signal by way of transistor Q50 in order to prevent Q49 from conducting, thereby halting the operation of the pre-regulator 202. In the preferred embodiment, the current initialization circuit 216 comprises p-channel FETs Q44–46 and n-channel FETs Q47–50.

The temperature-compensated reference voltage generator 200 may also include noise filtering circuits or devices. Specifically, in the preferred embodiment, the reference voltage generator 200 includes a filtering circuit 218 comprised of a p-channel FET Q51 having drain and source for receiving the unregulated power supply voltage AVDD and a gate for receiving the potential AVSS, which is typically at ground potential. In this configuration, transistor Q51 acts as a capacitor for filtering out noise and/or other unwanted signals from the unregulated input voltage AVDD.

In addition, the output reference voltage $V_{REF}$ of the reference voltage generator 200 may also include a filtering circuit 220 for filtering noise and/or unwanted signals present in the output reference voltage $V_{REF}$. In the preferred embodiment, the filtering circuit 220 comprises an n-channel FET Q52 having a gate for receiving the output reference voltage $V_{REF}$, and drain and source for receiving AVSS. In this configuration, transistor Q52 acts as a capacitor for filtering out noise and/or other unwanted signals from the output voltage $V_{REF}$.

While the invention has been described in connection with various embodiments, it will be understood that the invention is capable of further modifications. This application is intended to cover any variations, uses or adaptation of the invention following, in general, the principles of the invention, and including such departures from the present disclosure as come within known and customary practice within the art to which the invention pertains.

It is claimed:

1. An apparatus for producing an output voltage that is substantially invariant with changes in an environment temperature, comprising:

a current source for producing a current;

a current control circuit for controlling said current such that a compensating voltage is developed that varies with said environment temperature in accordance with a first temperature coefficient; and a first active device for developing a device voltage in response to said current, wherein said device voltage varies with said temperature in accordance with a second temperature coefficient that is substantially equal and opposite to said first temperature coefficient, said output voltage being a function of said device voltage and said compensating voltage.

2. The apparatus of claim 1, wherein said current control circuit includes said first active device.

3. The apparatus of claim 2, wherein said compensating voltage varies as a function of first and second parameters, said first parameter varies with said environment temperature in accordance with a third temperature coefficient, and said second parameter is selected such that said compensating voltage varies with said environment temperature in accordance with said first temperature coefficient.

4. The apparatus of claim 3, wherein said first active device includes a first diode and said first parameter includes a thermal voltage of said diode.

5. The apparatus of claim 3, wherein said second parameter is a function of a ratio of resistive elements, and a function of the junction area of said first diode.

6. The apparatus of claim 3, wherein said device voltage is across said first diode.

7. The apparatus of claim 5, wherein said current source includes first, second and third cascode current sources for producing first, second and third currents, and wherein said cascode current sources are configured to provide substantially identical currents and noise rejection of an input power supply to said current sources.

8. The apparatus of claim 6, wherein said current control circuit comprises:

a first series path comprising said first cascode current source and a first resistive element;

a second series path comprising said second cascode current source, a first FET, and said first diode, wherein said first series path is coupled to said second series path at a node between said first FET and said first diode; and a third series path comprising said third cascode current source, a second FET, a second resistive element and a second diode, wherein the gates of said first and second FETs are coupled together and to either said second and/or third cascode current sources; wherein said output voltage is developed across said first resistive element and said first diode, and said first current varies as a function of a ratio of said first and second resistive elements, a ratio of the junction areas of said first and second diodes, and the dimensions of said first and second FETs.

9. The apparatus of claim 8, wherein the second parameter varies according to the following equation:

$$(R1/R2)\ln\left(2\cdot\frac{A_2}{A_1}\right),$$

where R1 represents the resistance of the first resistive element, R2 represents the resistance of the second resistive element, $A_1$ represents the junction area of said first diode, and $A_2$ represents the junction area of said second diode.

10. The apparatus of claim 1, wherein said current control circuit comprises:

a first series path comprising a first current source and a first resistive element;

a second series path comprising a second current source, a first FET, and said first diode, wherein said first series path is coupled to said second series path at a node between said first FET and said first diode; and a third series path comprising a third current source, a second FET, a second resistive element and a second diode, wherein the gates of said first and second FETs are coupled together and to either said second and/or third current sources; wherein said output voltage is developed across said first resistive element and said first diode, and said output voltage is given by the following equation:

$$V_{REF} = V_{d1} + \frac{R1}{R2^2}\left[\frac{1}{2}\cdot\left(\frac{1}{\sqrt{\beta_1}} - \frac{1}{\sqrt{\beta_2}}\right)\right] \pm$$

-continued $$\frac{1}{2}\sqrt{\left(\frac{1}{\sqrt{\beta_2}}-\frac{1}{\sqrt{\beta_1}}\right)^2+4V_T\cdot R2\cdot\ln\left(\frac{2A_2}{A_1}\right)}\Bigg]^2$$

wherein $V_{d1}$ is the voltage across said first diode, R1 is the resistance of the first resistive element, R2 is the resistance of the second resistive element, $\beta_1$ the transconductance of said first FET, $\beta_2$ is the transconductance of said second FET, $V_T$ is the thermal voltage, $A_1$ is the junction area of said first diode, and $A_2$ is the junction area of said second diode.

11. A method of forming a voltage that is substantially invariant with changes in an environment temperature, comprising:

forming a current that develops a first voltage that varies with said environment temperature in accordance with a first temperature coefficient;

providing said current through a first active device that develops a second voltage that varies with said exposed temperature in accordance with a second temperature coefficient that is substantially equal and opposite to said first temperature coefficient; and forming said output voltage from said first and second voltages.

12. The method of claim 11, wherein said compensating voltage varies as a function of first and second parameters, said first parameter varies with said environment temperature in accordance with a third temperature coefficient, and said second parameter is selected such that said compensating voltage varies with said environment temperature in accordance with said first temperature coefficient.

13. The method of claim 12, wherein said first active device includes a first diode and said first parameter includes a thermal voltage of said diode.

14. The method of claim 13, wherein said second parameter is a function of a ratio of resistive elements, and a function of the junction area of said first diode.

15. The method of claim 14, wherein second voltage is across said first diode.

16. The method of claim 15, wherein said current source includes first, second and third cascode current sources for producing first, second and third currents, and wherein said cascode current sources are configured to provide substantially identical currents and noise rejection of an input power supply to said current sources.

17. The method of claim 16, wherein said current control circuit comprises:

a first series path comprising said first cascode current source and a first resistive element;

a second series path comprising said second cascode current source, a first FET, and said first diode, wherein said first series path is coupled to said second series path at a node between said first FET and said first diode; and a third series path comprising said third cascode current source, a second FET, a second resistive element and a second diode, wherein the gates of said first and second FETs are coupled together and to either said second and/or third cascode current sources; wherein said output voltage is developed across said first resistive element and said first diode, and said first current varies as a function of a ratio of said first and second resistive elements, a ratio of the junction areas of said first and second diodes, and the dimensions of said first and second FETs.

18. The method of claim 17, wherein the second parameter varies according to the following equation:

$$(R1/R2)\ln\left(2\cdot\frac{A_2}{A_1}\right),$$

where R1 represents the resistance of the first resistive element, R2 represents the resistance of the second resistive element, $A_1$ represents the junction area of said first diode, and $A_2$ represents the junction area of said second diode.

19. The method of claim 11, wherein said current control circuit comprises:

a first series path comprising a first current source and a first resistive element;

a second series path comprising a second current source, a first FET, and said first diode, wherein said first series path is coupled to said second series path at a node between said first FET and said first diode; and a third series path comprising a third current source, a second FET, a second resistive element and a second diode, wherein the gates of said first and second FETs are coupled together and to either said second and/or third current sources; wherein said output voltage is developed across said first resistive element and said first diode, and said output voltage is given by the following equation:

$$V_{REF}=V_{d1}+\frac{R1}{R2^2}\left[\frac{1}{2}\cdot\left(\frac{1}{\sqrt{\beta_1}}-\frac{1}{\sqrt{\beta_2}}\right)\pm\frac{1}{2}\sqrt{\left(\frac{1}{\sqrt{\beta_2}}-\frac{1}{\sqrt{\beta_1}}\right)^2+4V_T\cdot R2\cdot\ln\left(\frac{2A_2}{A_1}\right)}\right]^2$$

wherein $V_{d1}$ is the voltage across said first diode, R1 is the resistance of the first resistive element, R2 is the resistance of the second resistive element, $\beta_1$ is the transconductance of said first FET, $\beta_2$ is the transconductance of said second FET, $V_T$ is the thermal voltage, $A_1$ is the junction area of said first diode, and $A_2$ is the junction area of said second diode.

20. A reference voltage generator for producing an output voltage that is substantially invariant with changes in an environment temperature, comprising:

a pre-regulator producing an intermediate voltage that is potentially better regulated than an unregulated power supply voltage; and a temperature-compensating circuit, comprising:

a current source for producing a current in response to said intermediate voltage;

a current control circuit for controlling said current such that a first voltage is developed that varies with said environment temperature in accordance with a first temperature coefficient; and a first active device for developing a second voltage in response to said current, said device voltage varying with said temperature in accordance with a second temperature coefficient that is substantially equal and opposite to said first temperature coefficient, and said output voltage being a function of said first and second voltages.

21. The apparatus of claim 20, wherein said current controlling circuit includes said first active device.

22. The apparatus of claim 21, wherein said compensating voltage varies as a function of first and second parameters, said first parameter varies with said environment temperature in accordance with a third temperature coefficient, and said second parameter is selected such that said compensating voltage varies with said environment temperature in accordance with said first temperature coefficient.

23. The apparatus of claim 22, wherein said first active device includes a first diode and said first parameter includes a thermal voltage of said diode.

24. The apparatus of claim 22, wherein said second parameter is a function of a ratio of resistive elements and a function of the diode junction area.

25. The apparatus of claim 24, wherein said current source includes first, second and third cascode current sources for producing first, second and third currents, and wherein said cascode current sources are configured to provide substantially identical currents and noise rejection of an input power supply to said current sources.

26. The apparatus of claim 25, wherein said current control circuit comprises:

a first series path comprising said first cascode current source and a first resistive element;

a second series path comprising said second cascode current source, a first FET, and said first diode, wherein said first series path is coupled to said second series path at a node between said first FET and said first diode; and a third series path comprising said third cascode current source, a second FET, a second resistive element and a second diode, wherein the gates of said first and second FETs are coupled together and to either said second and/or third cascode current sources; wherein said output voltage is developed across said first resistive element and said first diode, and said first current varies as a function of a ratio of said first and second resistive elements, a ratio of the junction areas of said first and second diodes, and the dimensions of said first and second FETs.

27. The apparatus of claim 26, wherein the second parameter varies according to the following equation:

$$(R1/R2)\ln\left(2\cdot\frac{A_2}{A_1}\right),$$

where R1 represents the resistance of the first resistive element, R2 represents the resistance of the second resistive element, $A_1$ represents the junction area of said first diode, and $A_2$ represents the junction area of said second diode.

28. The apparatus of claim 22, wherein said second voltage is across said first diode.

29. The apparatus of claim 20, wherein said current control circuit comprises:

a first series path comprising a first current source and a first resistive element;

a second series path comprising a second current source, a first FET, and said first diode, wherein said first series path is coupled to said second series path at a node between said first FET and said first diode; and a third series path comprising a third current source, a second FET, a second resistive element and a second diode, wherein the gates of said first and second FETs are coupled together and to either said second and/or third current sources; wherein said output voltage is developed across said first resistive element and said first diode, and said output voltage is given by the following equation:

$$V_{REF} = V_{d1} + \frac{R1}{R2^2}\left[\frac{1}{2}\cdot\left(\frac{1}{\sqrt{\beta_1}} - \frac{1}{\sqrt{\beta_2}}\right) \pm \frac{1}{2}\sqrt{\left(\frac{1}{\sqrt{\beta_2}} - \frac{1}{\sqrt{\beta_1}}\right)^2 + 4V_T\cdot R2\cdot\ln\left(\frac{2A_2}{A_1}\right)}\right]^2$$

wherein $V_{d1}$ is the voltage across said first diode, R1 is the resistance of the first resistive element, R2 is the resistance of the second resistive element, $\beta_1$ is the transconductance of said first FET, $\beta_2$ is the transconductance of said second FET, $V_T$ is the thermal voltage, $A_1$ is the junction area of said first diode, and $A_2$ is the junction area of said second diode.

* * * * *